US011708693B2

(12) United States Patent
Sorel

(10) Patent No.: US 11,708,693 B2
(45) Date of Patent: Jul. 25, 2023

(54) MODIFIABLE AND REUSABLE MODULAR SOUNDPROOFING STRUCTURES

(71) Applicant: INNOVO INC., Boucherville (CA)

(72) Inventor: Maxime Sorel, Boucherville (CA)

( * ) Notice: Subject to any disclaimer, the term of this patent is extended or adjusted under 35 U.S.C. 154(b) by 1043 days.

(21) Appl. No.: 16/301,011

(22) PCT Filed: May 23, 2017

(86) PCT No.: PCT/CA2017/000131

§ 371 (c)(1),
(2) Date: Nov. 13, 2018

(87) PCT Pub. No.: WO2017/197490

PCT Pub. Date: Nov. 23, 2017

(65) Prior Publication Data

US 2019/0177969 A1 Jun. 13, 2019

Related U.S. Application Data

(60) Provisional application No. 62/339,373, filed on May 20, 2016.

(51) Int. Cl.

| | |
|---|---|
| ***E04B 1/84*** | (2006.01) |
| ***G10K 11/16*** | (2006.01) |
| ***E04B 2/74*** | (2006.01) |
| ***E04B 9/00*** | (2006.01) |

(52) U.S. Cl.

CPC ..... *E04B 1/8404* (2013.01); *E04B 2/7409* (2013.01); *E04B 9/001* (2013.01); *G10K 11/16* (2013.01)

(58) Field of Classification Search

CPC ..... E04B 1/8404; E04B 2/7409; E04B 9/001; G10K 11/16

USPC ..... 181/285

See application file for complete search history.

(56) References Cited

U.S. PATENT DOCUMENTS 5,272,284 A * 12/1993 Schmanski ..... E01F 8/0011 181/210
5,484,970 A * 1/1996 Suzuki ..... E04B 1/84 181/286
5,744,763 A * 4/1998 Iwasa ..... B29C 43/203 181/286
7,169,459 B2 * 1/2007 Lichodziejewski ..... B32B 3/20 428/188

(Continued)

FOREIGN PATENT DOCUMENTS

DE 19517364 A1 * 11/1996 ..... G10K 11/162
WO WO-9859128 A1 * 12/1998 ..... E04C 3/292

*Primary Examiner* — Forrest M Phillips
(74) *Attorney, Agent, or Firm* — Praxis

(57) ABSTRACT

A soundproofing structure comprises a jacket having an external surface and an opposite internal surface defining an inner compartment. A resilient and deformable soundproofing material is contained within the Inner compartment and engages the internal surface. Constricting elements are mounted to the jacket for constriction of the jacket to provide inner surface pressure against the soundproofing material for compression thereof. The constricting elements are releasable for selectively releasing inner surface pressure against the soundproofing material for expansion thereof against the inner surface. The soundproofing structure defines a size that is selectively modifiable by selective releasing of the contacting elements.

12 Claims, 9 Drawing Sheets

(56) References Cited

U.S. PATENT DOCUMENTS

| | | | | |
|---|---|---|---|---|
| 7,992,678 | B2 * | 8/2011 | Pilaar | B32B 3/06 181/284 |
| 8,469,144 | B2 * | 6/2013 | Pilaar | B32B 27/08 181/284 |
| 2014/0251720 | A1 * | 9/2014 | Daniszewski | F01N 13/1888 181/256 |
| 2019/0075948 | A1 * | 3/2019 | Reuben | A47G 9/04 |

* cited by examiner

MODIFIABLE AND REUSABLE MODULAR SOUNDPROOFING STRUCTURES

CROSS-REFERENCE TO RELATED APPLICATIONS

The present application claims priority on U.S. Provisional Patent Application No. 62/339,373, filed on May 20, 2016 and incorporated herein by reference in its entirety.

TECHNICAL FIELD

The present disclosure relates to soundproofing. More particularly, but not exclusively, the present disclosure relates to modifiable and reusable modular soundproofing structures.

BACKGROUND

Soundproofing is as well-known process of reducing the sound pressure with respect to a specified sound source and receptor. It is also well known to use noise barriers to reflect or absorb the energy of the sound waves. Absorbing sound converts part of the sound energy to a very small amount of heat in the absorbing material, rather than sound being transmitted or reflected. There are several ways in which a material can absorb sound. The choice of sound absorbing material will be determined by the frequency distribution of noise to be absorbed and the acoustic absorption profile required. Porous absorbers such as foams and sponges, absorb noise by friction within the cell structure. Soundproofing can suppress unwanted indirect sound waves such as reflections that cause echoes and resonances that cause reverberation. Soundproofing can reduce the transmission of unwanted direct sound waves from the source to an involuntary listener through the use of distance and intervening objects in the sound path. The foam or sponge material is spread in order to fill up an area, such as between walls or overhead structures.

OBJECTS

An object of the present disclosure is to provide a soundproofing structure.

An object of the present disclosure is to provide a soundproofing assembly.

An object of the present disclosure is to provide a kit for providing a soundproofing assembly.

An object of the present disclosure is to provide a method of soundproofing an area.

SUMMARY

In accordance with an aspect of the present disclosure, there is provided a soundproofing structure comprising: a jacket having an external surface and an opposite internal surface defining an inner compartment; a resilient and deformable soundproofing material contained within the inner compartment and engaging the internal surface; and constricting elements mounted to the jacket for constriction of the jacket to provide inner surface pressure against the soundproofing material for compression thereof, the constricting elements being releasable for selectively releasing inner surface pressure against the soundproofing material for expansion thereof against the inner surface, wherein the soundproofing structure defines a size, the size being selectively modifiable by selective releasing of the constricting elements.

In accordance with an aspect of the present disclosure, there is provided a soundproofing assembly comprising: a plurality of assembled soundproofing structures, wherein a given one of the plurality of soundproofing structures comprises: a jacket having an external surface and an opposite internal surface defining an inner compartment; a resilient and deformable soundproofing material contained within the inner compartment and engaging the internal surface; and constricting elements mounted to the jacket for constriction of the jacket to provide inner surface pressure against the soundproofing material for compression thereof, the constricting elements being releasable for selectively releasing inner surface pressure against the soundproofing material for expansion thereof against the inner surface, wherein the given one of the soundproofing structures defines a size, the size being selectively modifiable by selective releasing of the constricting elements.

In accordance with an aspect of the present disclosure, there is provided a kit for providing a soundproofing assembly, the kit comprising: a plurality of soundproofing structures for being assembled, wherein a given one of the plurality of soundproofing structures comprises: a jacket having an external surface and an opposite internal surface defining an inner compartment; a resilient and deformable soundproofing material contained within the inner compartment and engaging the internal surface; and constricting elements mounted to the jacket for constriction of the jacket to provide inner surface pressure against the soundproofing material for compression thereof, the constricting elements being releasable for selectively releasing inner surface pressure against the soundproofing material for expansion thereof against the inner surface, wherein the given one of the soundproofing structures defines a size, the size being selectively modifiable by selective releasing of the constricting elements.

In an embodiment, releasing of the constricting elements increases the size of the soundproofing structure. In an embodiment, the constricting elements are constrictable for selectively further constricting the jacket so as to provide further inner surface pressure against the soundproofing material for further compression thereof. In an embodiment, further constricting the jacket decreases the size of the soundproofing structure. In an embodiment, the constricting elements constrict additional jacket material extending from the jacket, wherein release of the constricting elements loosens the additional jacket material providing for the soundproofing material to expand against the loosened jacket material. In an embodiment, the constricting elements are selected from the group consisting of stitches, fasteners, zippers, laces, hook and loop fasteners, button fasteners, straps, belts, snap fasteners, hooks, pin fasteners, seals, connectors, bindings, junctions, couplings, clamps, ties, links, bonds, staples, inserts and any combination thereof.

In an embodiment, the soundproofing structure further comprises a block configuration and wherein the external surface comprises top and bottom sides, front and rear sides and lateral sides. In an embodiment, the constricting elements are provided on any one of the top and bottom sides, front and rear sides and lateral sides.

In an embodiment, the jacket comprises material selected from the group consisting of flexible and resilient material, malleable material, supple material, deformable material, impermeable material, water-proof material, fire resistant material and any combination thereof.

In an embodiment, the plurality of soundproofing structures are assembled in at least one vertical column.

In an embodiment, the plurality of soundproofing structures are assembled in at least one horizontal row.

In accordance with an aspect of the present disclosure, there is provided a method of soundproofing an area, the method comprising: providing a plurality of soundproofing structures comprising soundproofing resilient and deformable material enclosed within respective jackets and being compressed thereby; constricting the jacket against the soundproofing material for compression thereof; assembling the plurality of soundproofing structures in the area; and selectively releasing the constriction of the jacket against the soundproofing material for expansion thereof against the jacket, wherein the soundproofing structure defines a size, the size being selectively modifiable by selective releasing of constriction of the jacket.

In an embodiment, the method further comprises: assembling the plurality of soundproofing structures in at least one vertical column and/or in at least one horizontal row.

In an embodiment, the method further comprises: selectively further constricting the jacket of given one of the soundproofing structures against the soundproofing material for further compression thereof thereby decreasing the size of the given one of the soundproofing structures.

Other objects, advantages and features of the present disclosure will become more apparent upon reading of the following non-restrictive description of illustrative embodiments thereof, given by way of example only with reference to the accompanying drawings.

DETAILED DESCRIPTION OF ILLUSTRATIVE EMBODIMENTS

Figure 1:
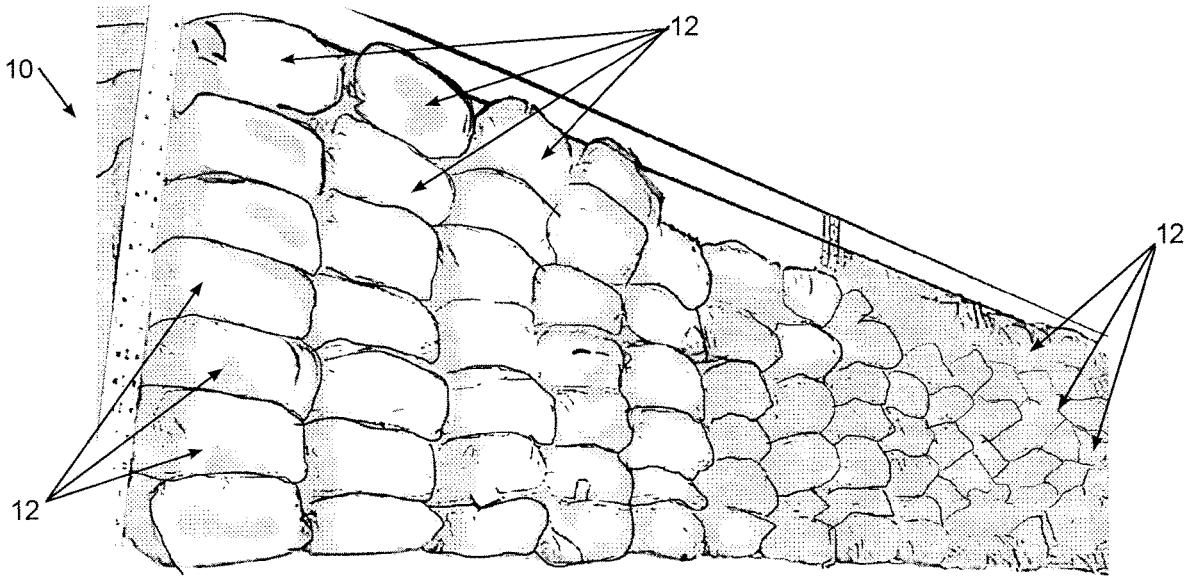
FIG. 1 is a front perspective view of an assembly of modifiable and reusable modular soundproofing structures in accordance with a non-restrictive illustrative embodiment of the present disclosure.

Generally stated and in accordance with an embodiment, there is provided a soundproofing structure comprising: a jacket having an external surface and an opposite internal surface defining an inner compartment; a resilient and deformable soundproofing material contained within the inner compartment and engaging the internal surface; and constricting elements mounted to the jacket for constriction of the jacket to provide inner surface pressure against the soundproofing material for compression thereof, the constricting elements being releasable for selectively releasing inner surface pressure against the soundproofing material for expansion thereof against the inner surface, wherein the soundproofing structure defines a size, the size being selectively modifiable by selective releasing of the constricting elements.

In an embodiment, the structures are stackable blocks made of jacketed, compressed acoustic material. They are used to fill the plenum space between a suspended ceiling and a ceiling slab or beneath a raised floor. These flexible blocks can be compressed or uncompressed, as needed, to accommodate the various elements found in the plenums of modern buildings. These flexible blocks are versatile, reusable and provided in various sizes, thicknesses and densities to adapt to any need and situation. They can be incorporated into an existing environments. The blocks can be quickly installed or retrofitted without noise or dust thereby providing hassle-free sound management.

In an embodiment, the constricting elements comprise tightening and releasing elements, such as for example, stitches for selectively tightening and releasing constriction of the jacket against the soundproofing material. As such, the size of the soundproofing structure is selectively modifiable by selectively tightening or releasing the constricting elements in conjunction with the pressing engagement of the soundproofing material against the inner surface of the jacket.

In an embodiment, releasing the constricting elements, allows the size of the soundproofing structure to increase as the soundproofing material outwardly pushes the barrier of jacket. The constricting elements can be mounted folded and stitched additional material of the jacket which is let loose and during release of constriction provided material slack for the jacket size (i.e. height and/or width and/or length). When the user wants to decrease the size of the soundproofing structure, the constricting elements are re-constricted thus removing the material slack by re-folding the additional material and pushing the barrier of jacket material and more specifically the inner surface against the resilient pressure of the deformable soundproofing material.

In an embodiment, the constricting elements comprise a zipper mechanism. The zipper mechanism functions much like a luggage bag for releasing or restricting the additional material to allow more or less bag volume. In still another embodiment, the constricting elements comprise laces and loops, releasing and restricting additional material much like for winter boots. In still another embodiment, the constricting elements comprise Velcro™. In yet another embodiment, the constricting elements comprise snap buttons. In still yet another embodiment, the constricting elements comprise comprises a seal that can be removed by pressure and re-sealed with suitable pressure. In yet still another embodiment, the constricting elements comprise magnetic elements. In still yet a further embodiment, the constricting elements comprise removable additional material. In yet still a further embodiment, constricting elements comprise hooks and loops. The skilled artisan will readily appreciate that the constricting elements may comprise various connectors, bindings, junctions, couplings, clamps, fasteners, ties, links, bonds, staples, inserts, and the like. Of course, the constricting elements comprise can also include any variety of combinations of the foregoing.

In an embodiment, the soundproofing structure comprises a jacket with a closure for selectively providing access to the internal compartment.

With reference, to the appended Figures, non-restrictive illustrative embodiments will be herein described so as to further exemplify the disclosure only and by no means limit the scope thereof.

Figure 2:
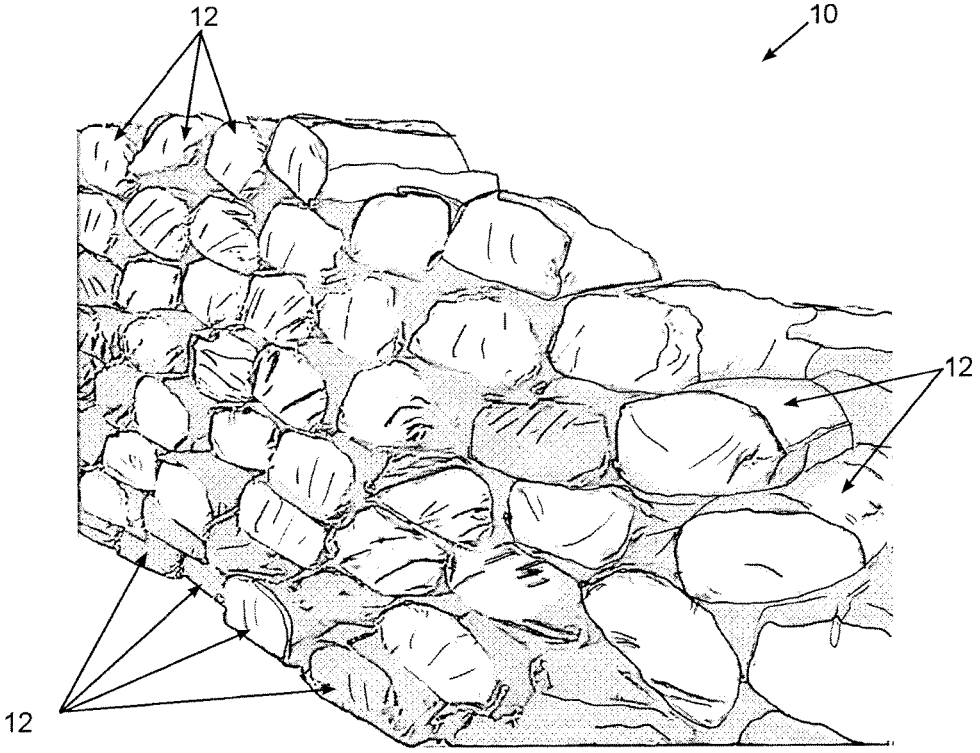
FIG. 2 is a rear perspective view of the assembly of FIG. 1.

FIGS. 1 and 2 show a modular soundproofing assembly 10 including a plurality of soundproofing structures 12. The plurality of soundproofing structures 12 are stacked and placed side by side forming vertical columns and horizontal rows with respect to the ground surface. In one embodiment, the assembly provides for building soundproofing wall structures.

Figure 3:
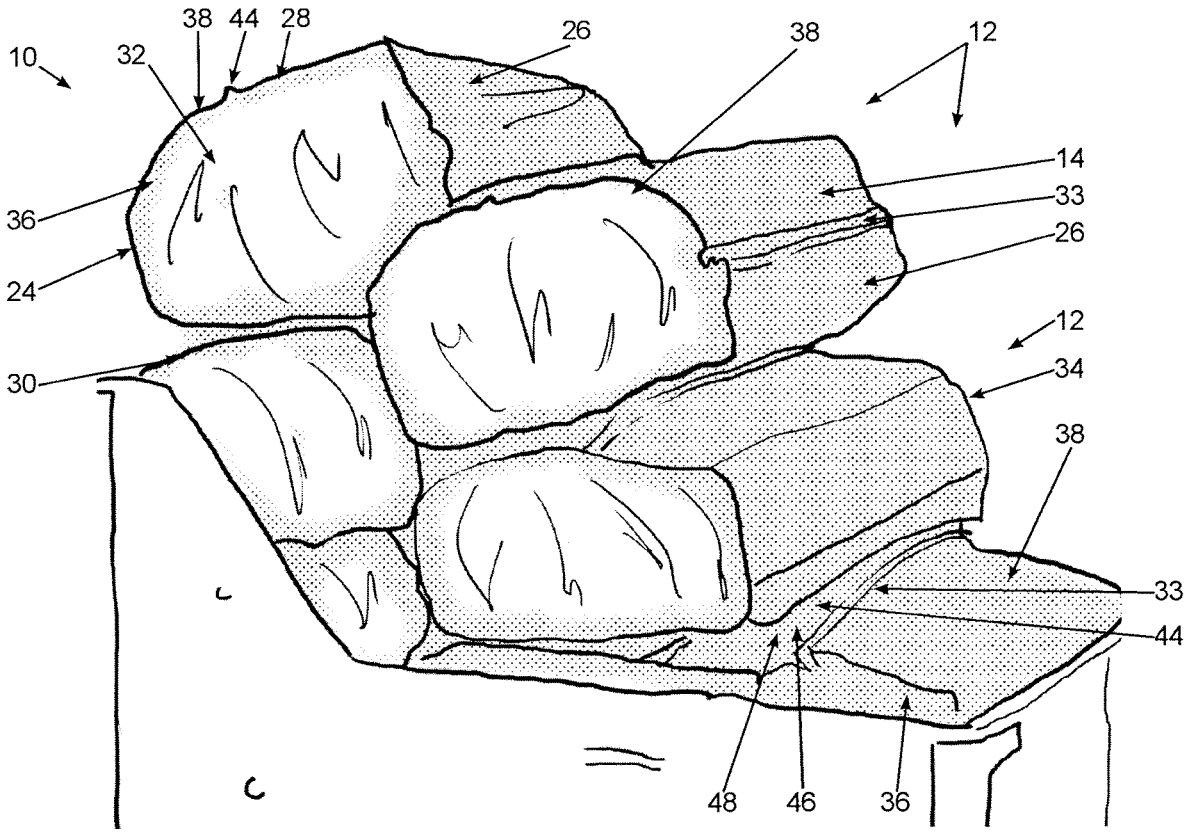
FIG. 3 is front perspective view of an assembly of the modifiable and reusable modular soundproofing structures in accordance with a non-restrictive illustrative embodiment of the present disclosure.

A shown in FIG. 3, the structures 12 are easily transportable for indoor usage in office or building spaces.

Figure 4:
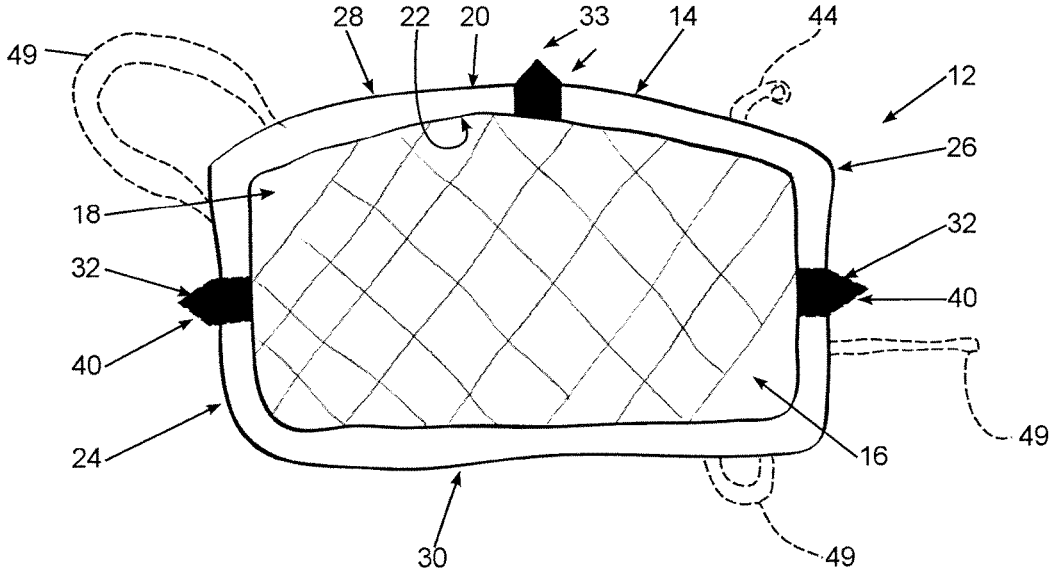
FIG. 4 is a cross-sectional schematic illustration of one of the modifiable and reusable modular soundproofing structures of the assembly of FIG. 1.
Figure 5:
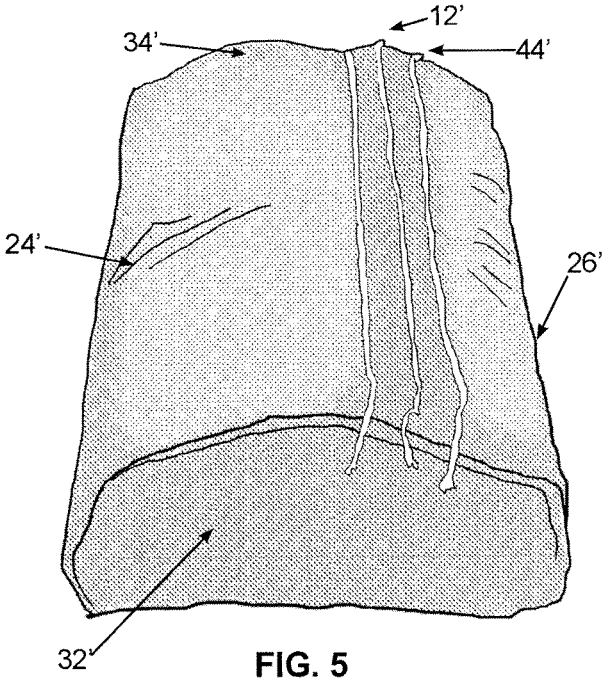
FIG. 5 is a top perspective view of a modifiable and reusable modular soundproofing structure in accordance with a non-restrictive illustrative embodiment of the present disclosure.
Figure 6:
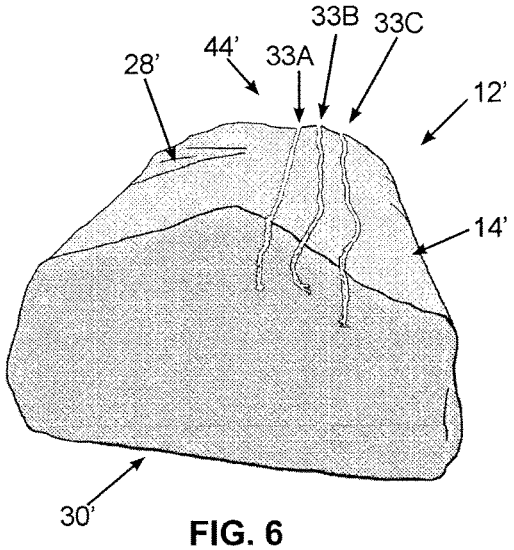
FIG. 6 is a front and top view of the soundproofing structure of FIG. 5.
Figure 7:
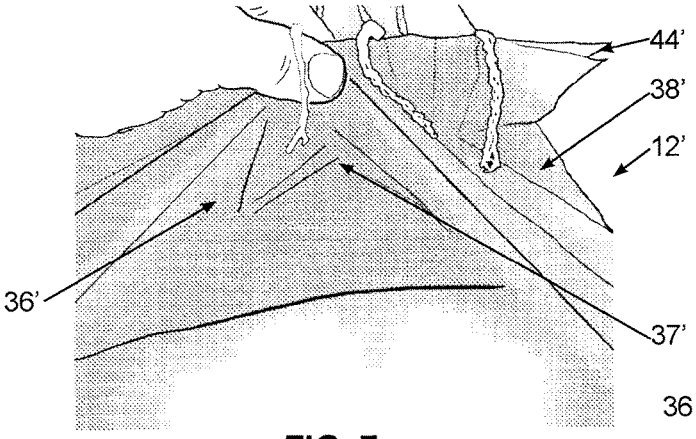
FIG. 7 is front view of the soundproofing structure of FIG. 6.
Figure 8:
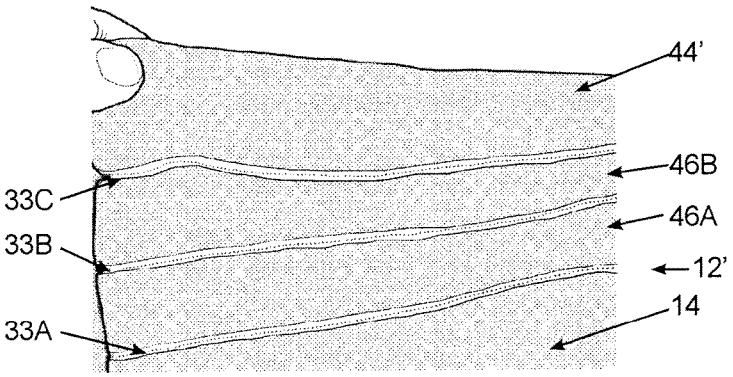
FIG. 8 is a side view of the top flap of the soundproofing structure of FIG. 6 in accordance with a non-restrictive illustrative embodiment of the present disclosure.

With reference to FIGS. 3 and 4, the soundproofing structure 12 includes a jacket (casing or housing) 14 for jacketing soundproofing material 16. In an embodiment, the jacket 14 is made of a fabric material. In an embodiment, the jacket 14 includes material selected from the group consisting of flexible and resilient material, malleable material, supple material, deformable material, impermeable material, water-proof material, fire resistant material and any combination of the foregoing. In an embodiment, such material is strong enough to resist impact, adverse conditions, and various external elements and protects the content therein as will be described herein. Furthermore, the material is malleable or supple or deformable as well as flexible enough to allow the structure 12 to be positioned in a variety of areas as will also be described herein.

As shown in FIG. 4, the jacket 14 defines an internal compartment 18 including the soundproofing material 16. The material 16 can include various types of soundproofing elements as is known in the art including foams, sponges, fabrics, and the like for acoustic absorption. The soundproofing material is deformable so as to be compressible under constriction and pressure and expandable or uncompressed when released from constriction and pressure.

The jacket 14 defines an external or outer wall surface 20 and an internal or inner surface 22 defining the compartment 18.

The soundproofing material 16 is enclosed within the compartment 18 so as not to spill out of the jacket 14. As such, the soundproofing structures 12 can be assembled in an area for soundproofing and then removed and re-used as the material 16 is, in essence, bagged and compartmentalized rather than being spread throughout an area as is known in the art. Therefore, the present structures 12 are reusable. The soundproofing material 16 pressingly engages the internal surface 22 therefore providing the soundproofing structure 12 with its volume and size.

In the non-limiting example shown in FIGS. 1-4, the soundproofing structure 12 is in the form of a block including lateral sides 24 and 26, top and bottom 28 and 30, respectively, and front and rear sides 32 and 34, respectively.

The soundproofing structure 12 comprises constricting elements 33 mounted to the jacket 14. In this example, the constricting elements 33 are stitches. The stitches 33 constrict the size of the jacket 14 against the soundproofing material 16. More particularly, the stitches 33 provide for pressing the inner surface 22 against the material 16 and the foregoing pressure compresses the material 16 decreasing it in size to a more compact form.

Figure 9:
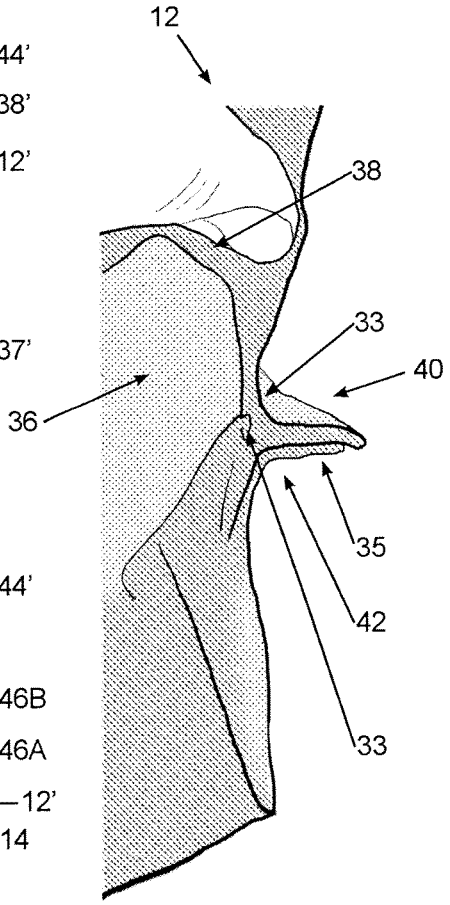
FIG. 9 is a front view of the lateral flap of one of the soundproofing structures of FIG. 1 in accordance with a non-restrictive illustrative embodiment of the present disclosure.

With reference to FIGS. 3, 4 and 9, the jacket 14 defines a base outer surface 36 that is covered by an additional outer surface 38. This additional outer surface 38 includes lateral flaps 40 that are stitched together via stitches 33. Removing the stitches 33 provides additional slack 42 to the flaps (via their additional unstitched material). The additional outer surface 38 also defines top flaps 44 that are stitched together via stitches 33. Removing the stitches 33 provides additional slack 46 to the flaps (via their additional unstitched material). Therefore, removal of stitches 33 from flaps 40 or flaps 44, releases the pressure of inner surface 22 on the material 16 causing material 16 to expandingly press back on the inner surface 22 pushing the jacket 14 outwardly for a distance allowed by the additional flap material 42 or 46. The flaps 40 and 44 are respectively connected at another position thereof such as position 35 for flaps 40 and position 48 for flaps 44 in order to avoid opening up the jacket 14 and fully decompressing the material 16. As such, the size of the soundproofing structure is increased.

Turning briefly to FIG. 4, the soundproofing structure 12 may also include one or more attachment element 49 on the external surface 22 which can be provided in a variety of forms as can be contemplated by the skilled artisan. The attachment element 49 provides for attaching the soundproofing structure 12 like structures or area structures such as pipes, beams, poles, rails and the like. The attachment element 49 may be hook, a belt, a loop, a fastener, and the like.

Turning now to FIGS. 5, 6, 7 and 8, there is shown a soundproofing structure 12' that is similar to soundproofing structure 12. Structure 12' is in the form of a block defining lateral sides 24' and 26', top and bottom 28' and 30', respectively, and front and rear sides 32' and 34', respectively. The jacket 14' defines a base outer surface 36' that is covered by an additional outer surface 38'. The additional outer surface 38' includes top flaps 44' which are stitched together via stitches 33A, 33B and 33C respectively positioned at three different positions A, B, C of the flaps 44'. Removing stitches 33A releases additional slack material 46A. Removing stitches 33B releases additional slack material 46B. Removing stitches 33C opens jacket 14'. The release of additional slack material 46A and 46B provides for the structure to correspondingly increase in size as the inner soundproofing material pushes the jacket 14' outwardly as explained above:

A space 37 (see FIG. 7) can be provided between the base outer surface 36 and the additional outer surface 38 as well as the base outer surface 36' and the additional outer surface 38" for receiving structure elements therebetween like wiring, beams and the like.

Figure 10:
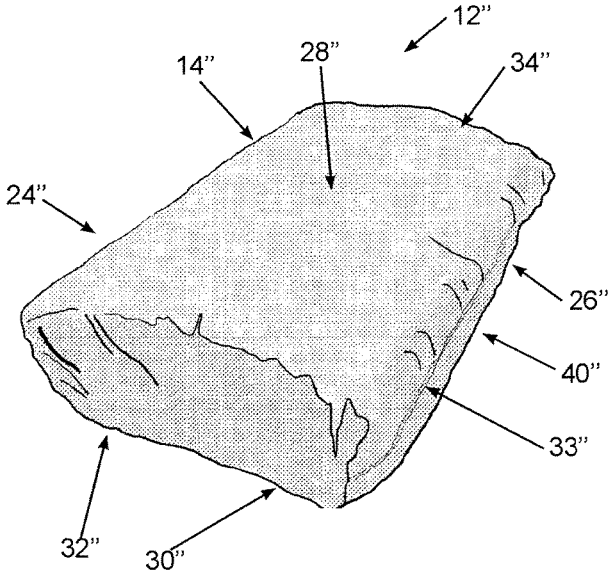
FIG. 10 is a top perspective view of a modifiable and reusable modular soundproofing structure in accordance with a non-restrictive illustrative embodiment of the present disclosure.
Figure 11:
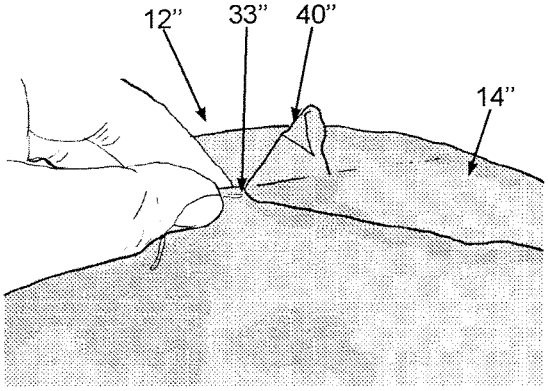
FIG. 11 is front view of the lateral flap of the soundproofing structure of FIG. 10 in accordance with a non-restrictive illustrative embodiment of the present disclosure.

Turning now to FIGS. 10 and 11, there is shown a soundproofing structure 12" that is similar to soundproofing structures 12 and 12'. Structure 12" is in the form of a flattened block defining lateral sides 24" and 26', top and bottom 28" and 30", respectively, and front and rear sides 32" and 34", respectively. The jacket 14" includes lateral flaps 40" with stitches 33" for being removed as previously discussed.

The size of the structures 12, 12', and 12" can be reduced by re-stitching the removed stitches or adding further stitching to further constrict the jackets 14, 14' and 14'".

Figure 12:
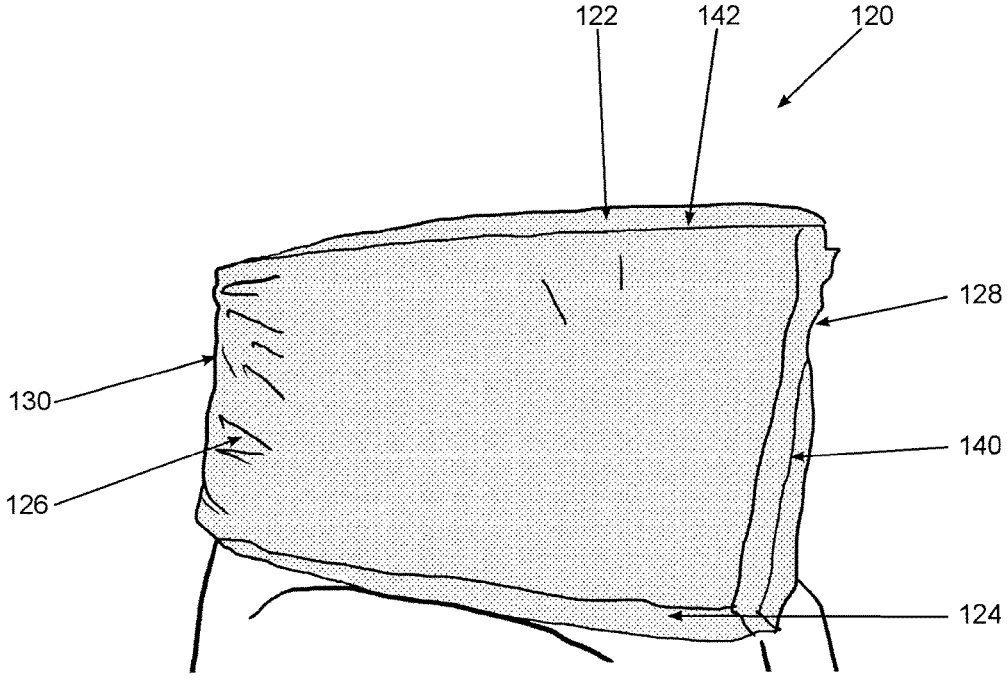
FIG. 12 is a side perspective view of a modifiable and reusable modular soundproofing structure in accordance with a non-restrictive illustrative embodiment of the present disclosure.

FIG. 12 shows a soundproofing structure 120 having a trapezoidal shape and defining top and bottom surfaces 122, and 124 respectively, lateral sides 126 (only one side shown) and front and rear sides, 128 and 130, respectively. The jacket 140 of the structure 120 is covered by a constricting element 142 in the form of a removable additional jacket for compressing the material within the jacket 140. When removing the additional jacket 142, the pressure on the internal soundproofing material is released and the material expands outwardly pushing the jacket 140 and increasing the size of the structure 120.

Figure 13:
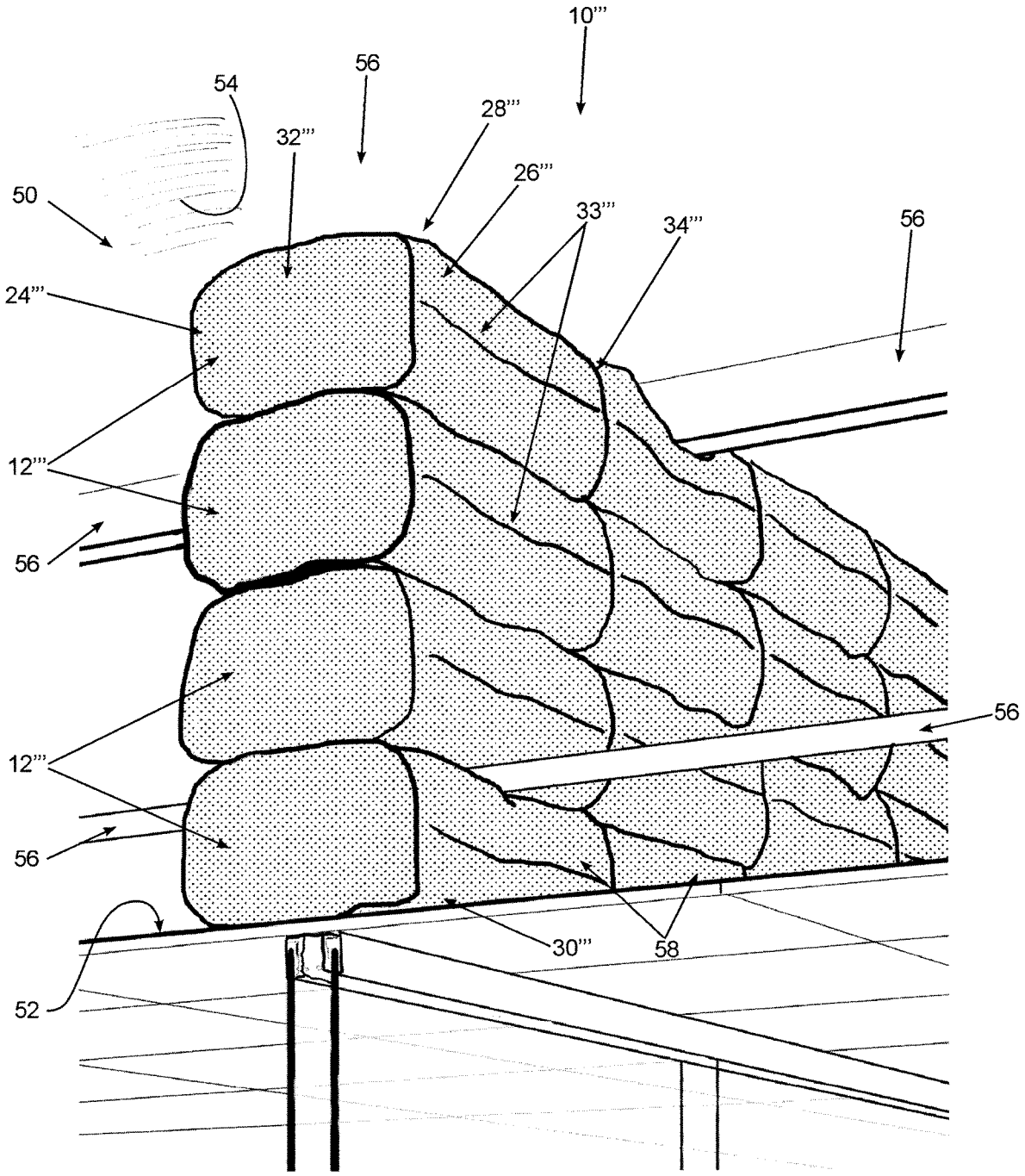
FIG. 13 is a front and aide perspective view of an assembly of modifiable and reusable modular soundproofing structures in accordance with a non-restrictive illustrative embodiment of the present disclosure.
Figure 14:
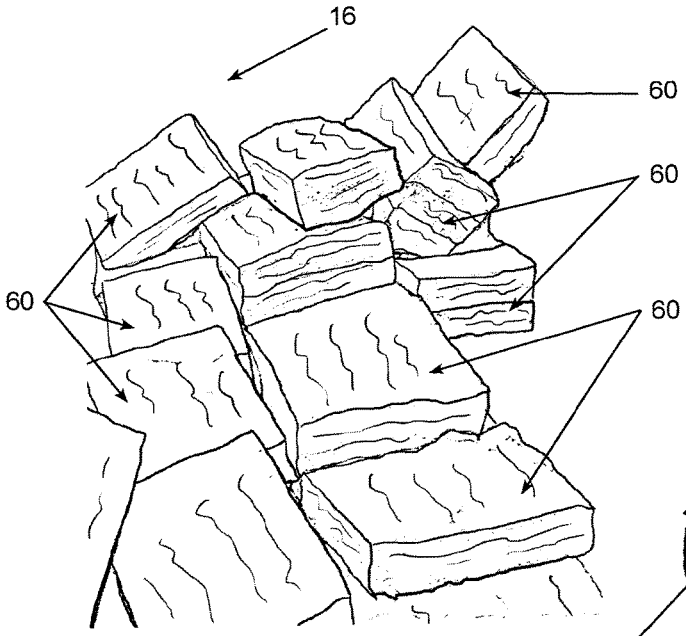
FIG. 14 is a perspective view of a plurality of blocks of soundproofing material for the soundproofing structures of FIG. 1 in accordance with a non-restrictive illustrative embodiment of the present disclosure.

FIG. 13 shows an assembly 10'" of soundproofing structures 12'" which are similar to structures 12, 12' and 12". In this example, the assembly 10'" has been placed in a space 50 defined between a suspended ceiling 52 and the overhead structure 54. In this example, a vertical column 56 of stacked structures 12'" occupies the space between the suspended ceiling 52 and the overhead structure 54. As shown the structures 12'" are flexible and resilient (i.e. deformable) and therefore deform around railings and other fixtures, generally denoted 56.

The structure 12'" includes a jacket 14'" for enclosing therein the deformable and resilient soundproofing material. The structure 12'" is a block defining lateral sides 24'" and 26'", top and bottom surfaces 28'" and 30'", respectively, and front and rear faces 32'" and 34'" respectively. Constricting elements 33'" are mounted to the jacket 14'" on the lateral sides 24'" and 26'" thereof. The constricting elements 33'" are concealed under a ridge 58 of material extending from the jacket 14'" that can be turned over to reveal the constricting elements 33'". Accordingly, the constricting elements 33'" can be stitches, zipper fasteners, laces, hook and loop fasteners, button fasteners, straps, belts, snap fasteners, hooks, pin fasteners and any combination of the foregoing. Thus, if the uppermost block 12'" of vertical column 56 does not engage the overhead structure 54, the constricting elements 33'" can be released by unstitching, unzipping, unfastening, unstrapping, unhooking, unlacing and the like to add additional height (as well as width). If it is desired to reduce the size of the block 12'" then the constricting elements 33'" can stitched, zipped, fastened, laced, hooked, strapped and the like to reduce height and width.

Of course, the constricting elements 33, 33', 33", and 33'" can be so positioned on the jackets 14, 14', 14", and 14'" in order to increase or reduce length of the structures 12, 12', 12", 12'".

With reference to FIGS. 14 to 21, the method of assembling a soundproofing structure 12 will now be discussed in accordance with a non-limiting illustrative embodiment of the present disclosure.

Figure 15:
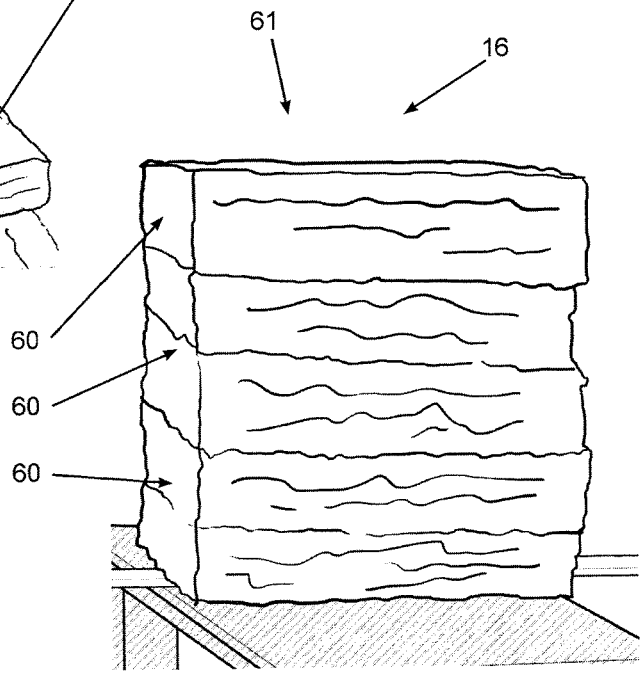
FIG. 15 is front view of a stacked pile of the plurality of blocks of soundproofing material of FIG. 14.
Figure 16:
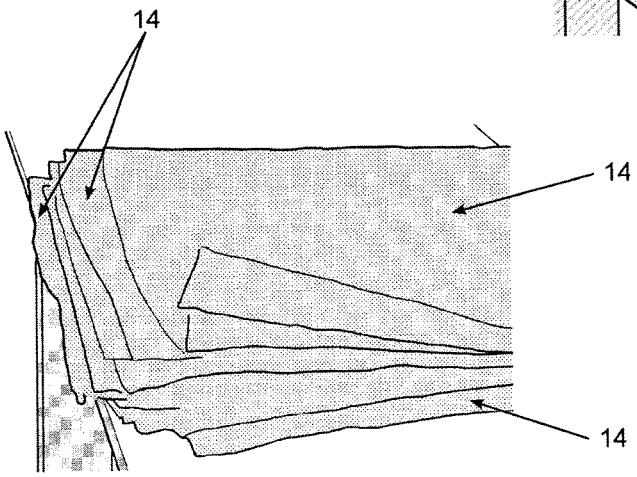
FIG. 16 is a top perspective view of a plurality of jackets for the soundproofing structures of FIG. 1 in accordance with a non-restrictive illustrative embodiment of the present disclosure.
Figure 17:
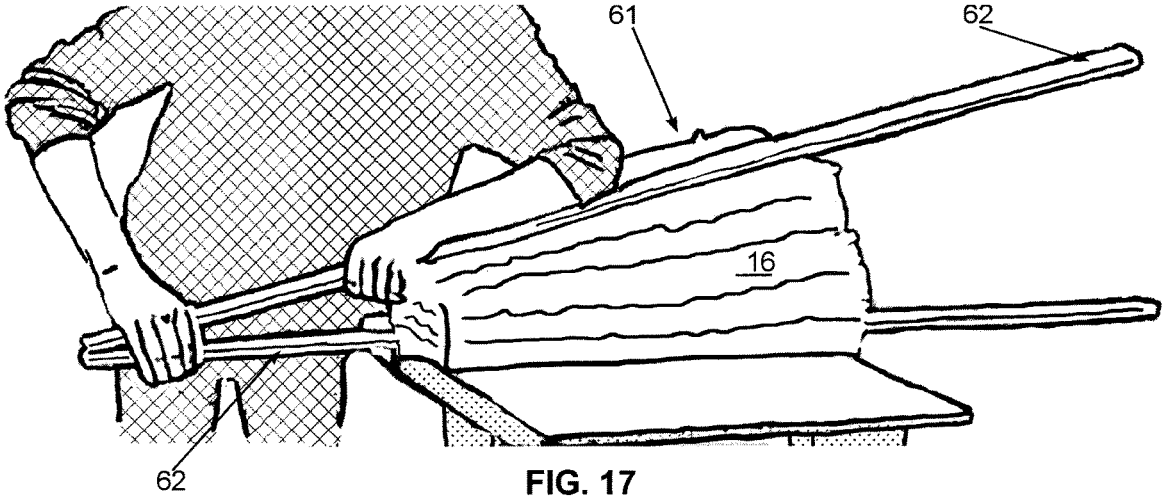
FIGS. 17 to 21 are front perspective views of the steps for assembling the stacked pile of FIG. 25 into one of the jackets of FIG. 16 in accordance with a non-restrictive illustrative embodiment of the present disclosure.
Figure 18:
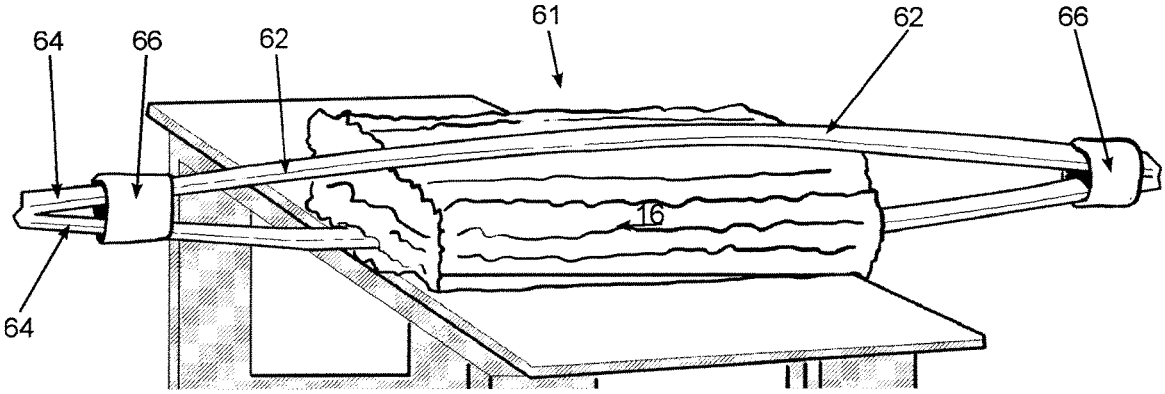
Figure 19:
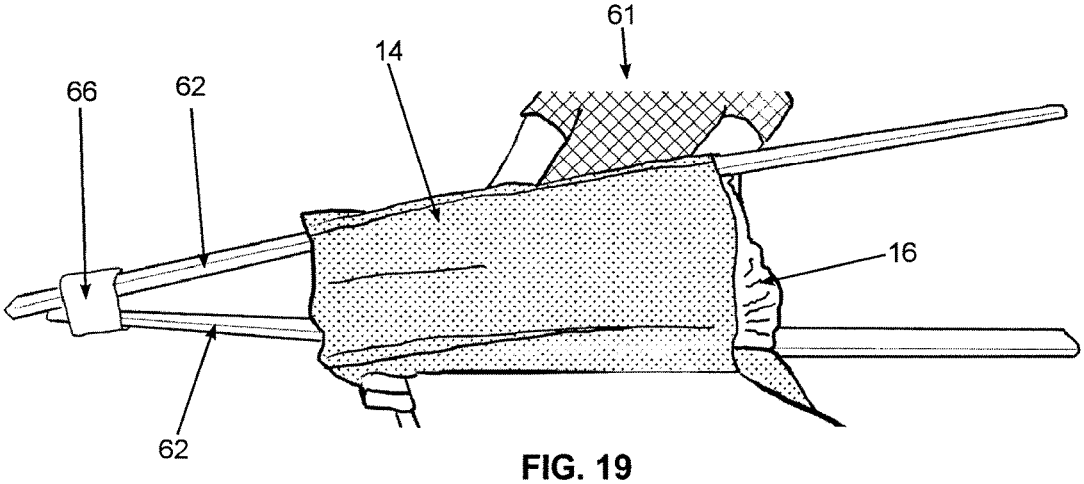
Figure 20:
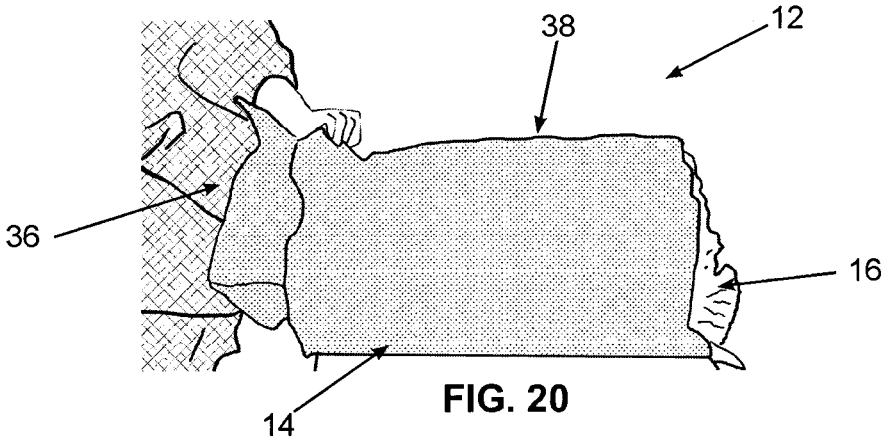
Figure 21:
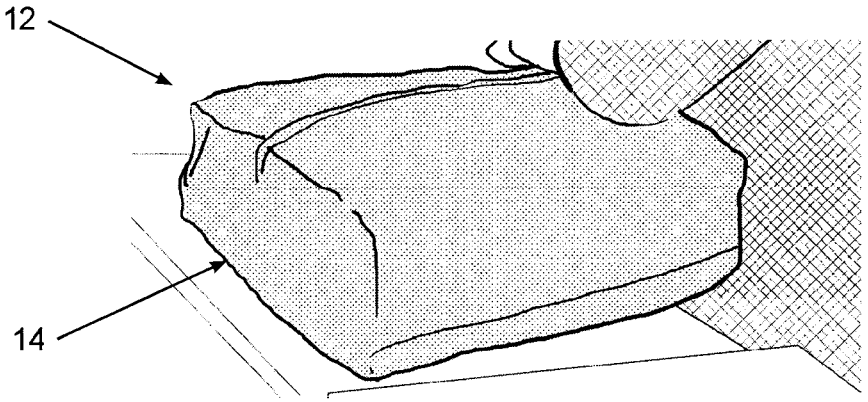

The soundproofing material 18 is provided in blocks 60 (see FIG. 14) that are stacked together in a vertical pile 61 (see FIG. 15). In one example, the soundproofing material 16 comprises nonwoven polypropylene. In one example, the soundproofing material 16 comprises Fabtex™ material. The vertical pile 61 of soundproofing material is fitted within one of the jackets 14 (see FIG. 16). As shown in FIGS. 17 to 19, the pile 61 is compressed to be fitted into one of the jackets 14. More particularly, a pair of flexible boards 82 are used to sandwich the pile 61 therebetween and compress it to a shorter height. One board 62 is placed beneath the pile 61 and the other board 62 on top of the pile 61. The pile 61 is compressed downwardly as shown in FIG. 17 and the ends 64 of top and bottom boards 62 are clamped together via clamps 66. A jacket 14 is opened and the clamped boards 62 with the soundproof material 16 compressed therebetween are fitted within the jacket 14. Once the jacket 14 is properly positioned, the clamps 66 are removed and the boards 62 are slid out of the jacket 14. With the jacket 14 maintaining the soundproofing material in a compressed form. The jacket 14 is then closed as shown in FIGS. 20 and 21 by simply sliding the base outer surface material 36 underneath the additional outer surface material 38.

In an embodiment, the pile 61 is compressed from a height of about 24 inches to about 10 inches within the jacket 14.

Figure 22:
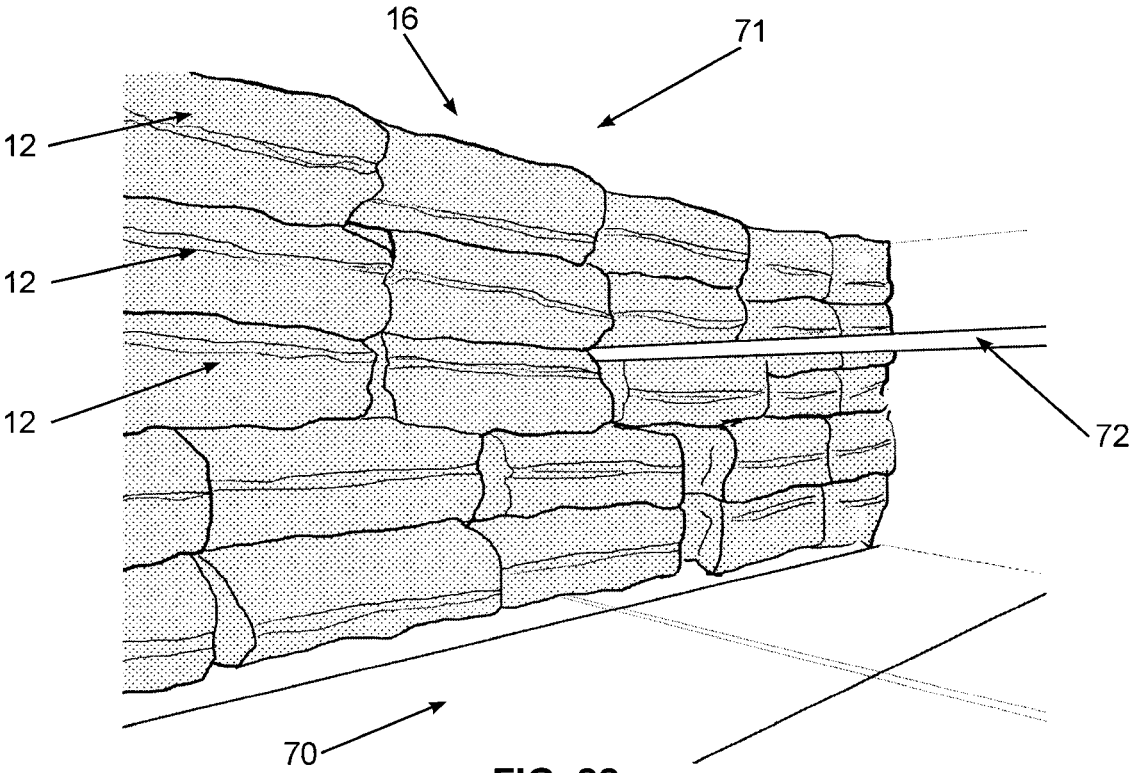
FIG. 22 is a front and side perspective view of the assembly in FIG. 1, assembled in an area for soundproofing thereof in accordance with a non-restrictive illustrative embodiment of the present disclosure.
Figure 23:
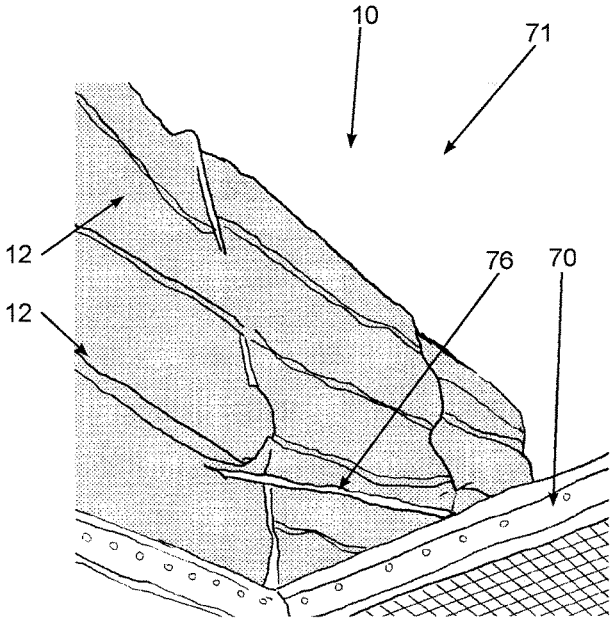
FIG. 23 is a front, side and bottom perspective view of the assembly in FIG. 1, assembled in an area for soundproofing thereof in accordance with a non-restrictive illustrative embodiment of the present disclosure.
Figure 24:
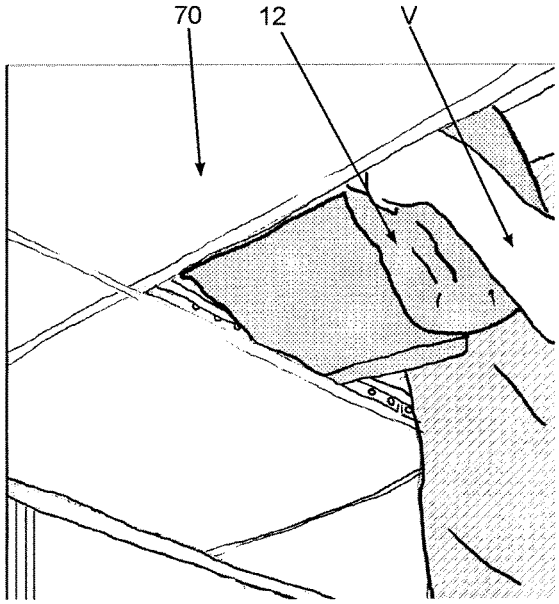
FIG. 24 is a bottom perspective view of a user placing the soundproofing structure of FIG. 1 into art overhead area for soundproofing thereof in accordance with a non-restrictive illustrative embodiment of the present disclosure.
Figure 25:
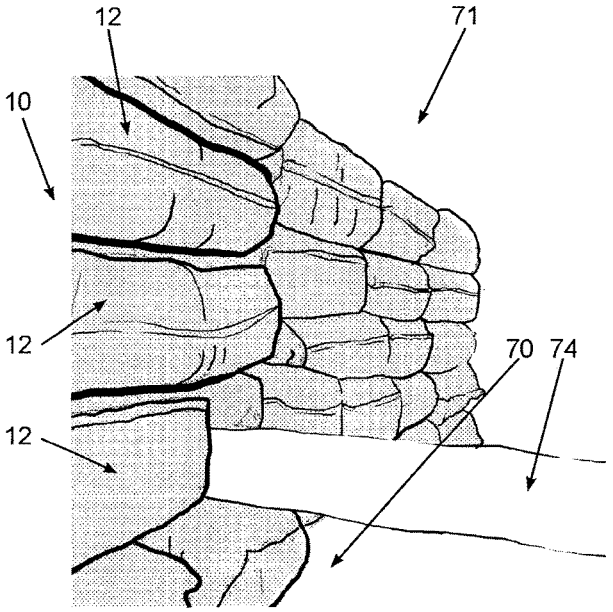
FIG. 25 is a side and front perspective view of the assembly in FIG. 1, assembled in an area for soundproofing thereof in accordance with a non-restrictive illustrative embodiment of the present disclosure.
Figure 26:
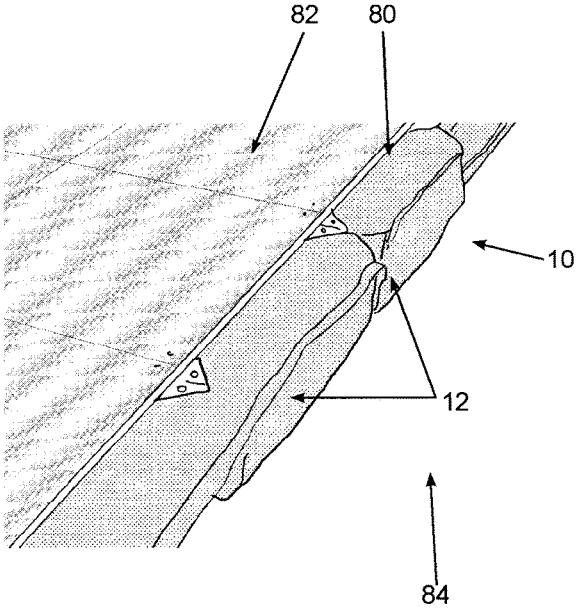
FIG. 26 is a top perspective view of the assembly in FIG. 1, positioned within an area for soundproofing thereof in accordance with a non-restrictive illustrative embodiment of the present disclosure.

Turning now to FIGS. 22 to 26, there is shown a variety of areas in which the soundproofing structures 12 can be positioned and assembled for forming modular assemblies 10 such as barriers or dividers or separations. For example, the malleability and resilience of the soundproofing structures 12 allows an assembly thereof 10, to be sandwiched between a suspended ceiling 70 and an overhead structure 71 as shown in FIG. 22 for example or sandwiched within in a narrower recess BO between tow planar and spaced apart floor structure 82 and 84 as show in FIG. 26. The structures 12 can be deformed against its configuration in order to allow passage for a large obstruction such as a pipe 72 as shown in FIG. 22 or a duct 74 as shown in FIG. 25, or a small 4 obstruction such as a wire 76 as shown in FIG. 23. The shape of the soundproofing structures allows the structure 12 to be easily and securely stacked as shown in FIGS. 22, 23 and 25 for example. The structures 22 difficult areas such as corners or areas with many encumbrances. A shown in FIGS. 8 and 9, the soundproofing structures 12 are easy to handle and relatively light allowing a user U to position them in an overhead structure for example, or to remove them for repairs and the reassemble them.

In an embodiment, the soundproofing structures provide for absorbing sound from and greater than 200 Hz and onwards. In an embodiment, the soundproofing structures and assemblies herein are used in the absorption of sound between 500 Hz and 1500 Hz. In an embodiment, the soundproofing structures and assemblies provided herein are used in the absorption of sound greater than 1000 Hz.

The present structures and assemblies provide for using more soundproofing material since the soundproofing material is compressed within the jacket and provided in a smaller format.

It should be noted that the constricting elements described herein are provided for selectively modulating the size of the present structures 12. As such, when piling or stacking a plurality of structures 12 between two opposite wall, e.g. a ceiling and a floor, there may be an extra gap between the uppermost structure 12 and the ceiling that does not allow enough space for an additional structure. Releasing the constricting elements provides for augmenting the volume of the structure 12 thereby filling this gap. In another similar example, the last piled structure 12 may be too large and as such, restricting the volume of the last structure provides for fitting it between the ceiling and the next uppermost structure 12 directly beneath this last structure 12.

The enclosed structures 12 are also healthier than using unpackaged, loose foam as foam fibers and dust particles can enter air ducts and be breathed in by individuals within the insulated rooms of a given building. Moreover, loose foam is avoided as it is not needed for filling gaps between the structures 12 and wall structures since the volume of the structures can be selectively modulating in order to accommodate such gaps as explained above. Therefore, the use of the structures 12 improves air quality as compared to the use of loose unpackaged foam avoiding respiratory issues caused by such foams.

In an embodiment, when assembling any of the assemblies 10, 10', 10" or 10'" herein, the user may project light onto the assembly in order to evaluate if light is passing through to the other side and as such, plug the holes or empty spots (which allow light to pass thought) by increasing the size of the structures 12, 12', 12", 12'" and 120 or adding more such structures to the assembly or adding other material to plug the holes and empty spots.

In one example, the present structures 12, 12', 12", 12'" and 120 are used in combination with modular walls and partitions.

In one example, the present structures 12, 12', 12", 12'" and 120, assemblies 10, 10', 10", 10'" and kits can be used in conjunction with one or more other elements such as and without limitation to curtains, blocs, inserts, and the like.

Of course, the skilled artisan will readily appreciate that various convenient sizes, configurations, formats and shapes can be contemplated for the structures 12, 12', 12", 12'" and 120 provided herein.

The various features described herein can be combined in a variety of ways within the context of the present disclosure so as to provide still other embodiments. As such, the embodiments are not mutually exclusive. Moreover, the embodiments discussed herein need not include all of the features and elements illustrated and/or described and thus partial combinations of features can also be contemplated. Furthermore, embodiments with less features than those described can also be contemplated. It is to be understood that the present disclosure is not limited in its application to the details of construction and parts illustrated in the accompanying drawings and described hereinabove. The disclosure is capable of other embodiments and of being practiced in various ways. It is also to be understood that the phraseology or terminology used herein is for the purpose of description and not limitation. Hence, although the present disclosure has been provided hereinabove by way of non-restrictive illustrative embodiments thereof, it can be modified, without departing from the scope, spirit and nature thereof and of the appended claims.

What is claimed is:

1. A soundproofing structure comprising:

a jacket of malleable fabric material having an external surface and an opposite internal surface defining an inner compartment;

a resilient and deformable soundproofing material contained within the inner compartment and engaging the internal surface, the soundproofing material being selected from the group consisting of foam, sponges, fabrics and combinations thereof; and constricting elements mounted to the jacket for constriction of the jacket to provide inner surface pressure against the soundproofing material for compression thereof, the constricting elements being releasable for selectively releasing inner surface pressure against the soundproofing material for expansion thereof against the inner surface, wherein the soundproofing structure comprises a block configuration and the external surface defines top and bottom sides, front and rear sides and lateral sides, wherein the constricting elements are provided on any one of the top and bottom sides, front and rear sides and lateral sides, wherein the soundproofing structure defines a size thereof, the size being selectively modifiable by selective releasing of and further constricting of the constricting elements, wherein releasing of the constricting elements increases the size of the soundproofing structure and further constricting of the constricting elements decreases the size of the soundproofing structure providing further inner surface pressure against the soundproofing material for further compression thereof, wherein the soundproofing structure is flexible, malleable, supple and deformable.

2. A soundproofing structure according to claim 1, wherein the jacket defines a base outer surface covered by an additional outer surface, the additional outer surface including lateral flaps, the constricting elements comprise stitches stitching together the lateral flaps, wherein removal of the stitches provides additional slack to the flaps by releasing additional material thereby increasing the size of the soundproofing structure.

3. A soundproofing structure according to claim 1, wherein the constricting elements constrict additional jacket material extending from the jacket, wherein release of the constricting elements loosens the additional jacket material providing for the soundproofing material to expand against the loosened jacket material.

4. A soundproofing structure according to claim 1, wherein the constricting elements are selected from the group consisting of stitches, fasteners, zippers, laces, hook and loop fasteners, button fasteners, straps, belts, snap fasteners, hooks, pin fasteners, seals, connectors, bindings, junctions, couplings, clamps, ties, links, bonds, staples, inserts and any combination thereof.

5. A soundproofing structure according to claim 1, wherein the jacket comprises material selected from the group consisting of flexible and resilient material, impermeable material, water-proof material, fire resistant material and any combination thereof.

6. A soundproofing assembly comprising:

a plurality of the soundproofing structures of claim 1 assembled together.

7. An assembly according to claim 6, wherein the plurality of soundproofing structures are assembled in at least one vertical column.

8. An assembly according to claim 6, wherein the plurality of soundproofing structures are assembled in at least one horizontal row.

9. A kit for providing a soundproofing assembly, the kit comprising:

a plurality of the soundproofing structures of claim 1 for being assembled.

10. A method of soundproofing an area, the method comprising:

assembling a plurality of the soundproofing structures of claim 1 in the area; and selectively releasing the constriction of the jacket of a given one or given ones of the plurality of the soundproofing structures to increase the size thereof and/or selectively further constricting the constricting elements of another given one or other given ones of the plurality of the soundproofing structures to increase the size thereof.

11. A method according to claim 10, further comprising assembling the plurality of soundproofing structures in at least one vertical column.

12. A method according to claim 10, further comprising assembling the plurality of soundproofing structures in at least one horizontal row.

* * * * *